United States Patent [19]

Fleming et al.

[11] Patent Number: 4,856,493

[45] Date of Patent: Aug. 15, 1989

[54] QUICK CONNECT-DISCONNECT PANEL MOUNTING MEANS

[75] Inventors: Thomas W. Fleming, Van Nuys; Gary D. Rose, Anaheim, both of Calif.

[73] Assignee: Jensen General Corp., Los Angeles, Calif.

[21] Appl. No.: 225,469

[22] Filed: Jul. 28, 1988

[51] Int. Cl.[4] ..... F24C 15/20

[52] U.S. Cl. ..... 126/299 R; 49/463; 126/299 D; 248/222.2; 248/225.1

[58] Field of Search ..... 126/299 R, 299 D, 299 C, 126/319; 49/465, 463; 248/222.2, 225.1, 223.3, 221.4; 52/476

[56] References Cited

U.S. PATENT DOCUMENTS

| | | | |
|---|---|---|---|
| 2,570,714 | 10/1951 | Robinson | 126/319 |
| 3,937,537 | 2/1976 | Diettrich | 49/463 |
| 4,340,144 | 7/1982 | Cousins | 248/222.2 |

*Primary Examiner*—James C. Yeung

*Attorney, Agent, or Firm*—Harlan P. Huebner

[57] ABSTRACT

A monitor panel for insertion into a range hood for use in recreational vehicles wherein said panel employs locking wall means for quick connect-disconnect hand insertion and removal of the panel from an opening in said range hood. Said locking wall means cooperate with said monitor panel to maintain said panel within said opening against said range hood.

5 Claims, 2 Drawing Sheets

FIG. 1.
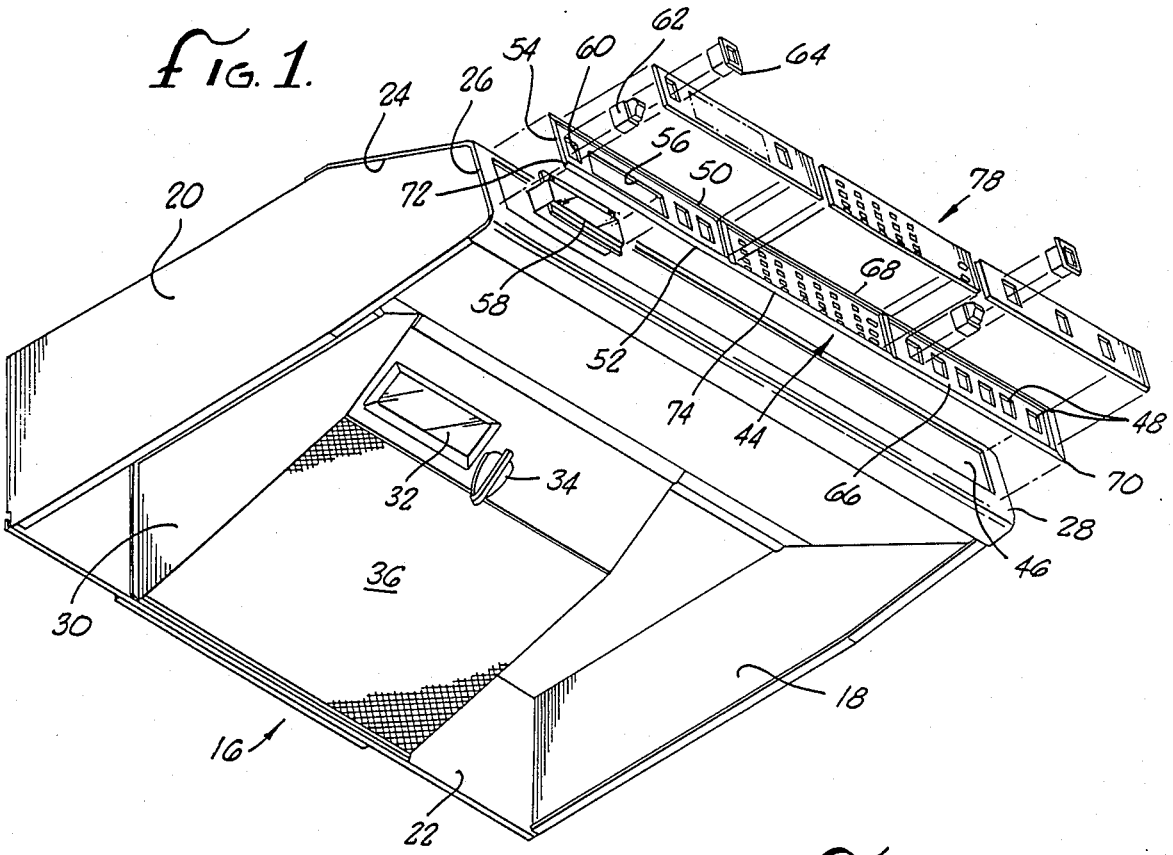
FIG. 2.
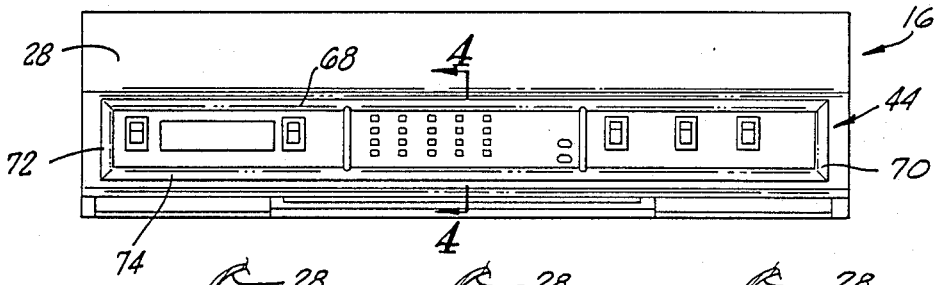
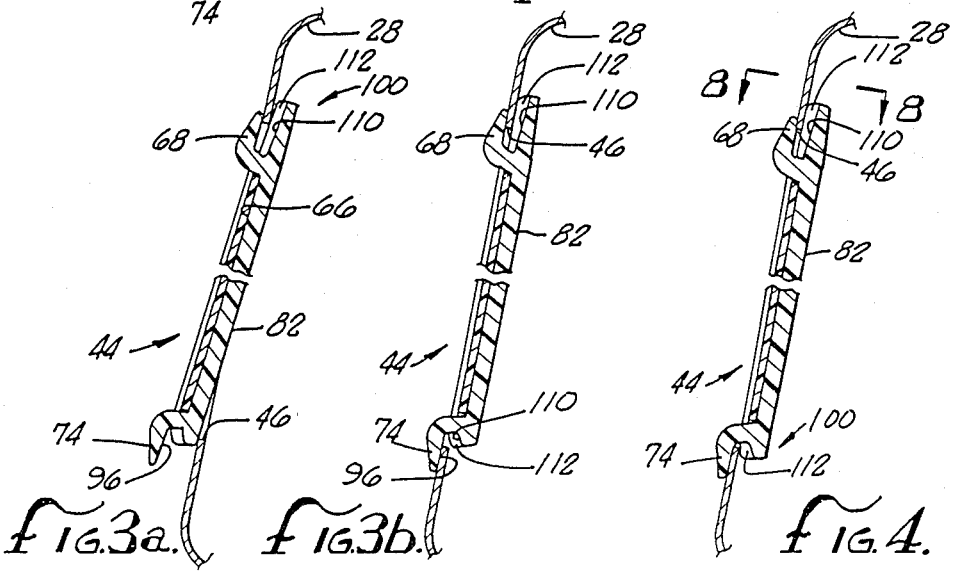
FIG. 3a. FIG. 3b. FIG. 4.

QUICK CONNECT-DISCONNECT PANEL MOUNTING MEANS

BACKGROUND OF THE INVENTION

1. Field of the Invention

This invention relates to quick connect-disconnect panel mounting means for monitoring panels to be affixed to range hoods for recreational vehicles.

2. Description of the Prior Art

With the advent of the placing of stoves and ovens in recreational vehicles, range hoods have been installed to evacuate cooking smells and heat from the interior confines.

A range hood generally includes on the front face a control to turn on a fan within the range hood, sometimes there is a control to turn on a light under the hood.

In view of the fact that in recreational vehicles there are a number of things that need to be monitored, it has been found that by placing a panel with monitoring gauges etc. on the front of the hood visual monitoring could take place. In other words, the panel might include a water gauge to determine the level of water, a battery charge gauge, a clock and a number of other types of gauges particular to recreational vehicles.

With the advent of the panel to receive gauges, etc. it became incumbent to form removable panels that could be inserted in the front of a range hood. The removability was important because today the recreational vehicle industry may tailor make monitor panels to the purchasers requirements. Thus, by having separate so called personalized monitor panels to affix to range hoods it is not necessary to go to the expense of making a whole hood and panel combination each time some other gauge is needed.

In the past the monitor panels have been connected to range hood by screws, drive rivets and spring clips. Each of these fastening means has its disadvantage.

When screws are used additional time is required to remove the screws necessitating at least a screw driver. With the use of plastic drive rivets, while they may be pushed out and to some extent reused, if not removed properly they can break and not be reusable. On the other hand spring clips require the additional manufacturing time of riveting them in place. Also with the spring clips, to physically remove them requires physical stamina and in some cases an instrument to pry them open.

Up until the present there has been no quick connect-disconnect locking or mounting means to retain a monitor panel within a range hood for recreational vehicles.

SUMMARY OF THE INVENTION

It is a purpose of the present invention to provide a number of mounting or locking clips members on a monitor panel that are adapted to extend from a panel and clip onto a range hood of a recreational vehicle to hold the panel in place.

Another object of the present invention is to provide mounting or locking clips either as a part of the back of a panel or separately attached to a panel.

Another object of the present invention is to provide upper and lower mounting or locking clips on a monitor panel.

A still further object of the present invention is to provide upper and lower mounting or locking clips in the panel wherein one series, either the upper or lower clips is generally shorter than the other series to facilitate installation.

A yet further object of the present invention is to provide a series of clips that include an internal biasing portion that engages the range hood to removably lock the monitor panel to the range hood.

A still further object is to provide mounting or locking clip members that require no tool to disengage the clip members to connect or disconnect a monitor panel.

Another object is to provide mounting or locking clip members on a monitor panel which are permanent and reusable along with the panel.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which:

FIG. 1, is a perspective environmental view of range hood for a recreational vehicle and monitor panel in an exploded view;

FIG. 2 is a front elevational view of a monitor panel being held in place by quick connect-disconnect mounting means of the present invention;

FIGS. 3*a* and 3*b* are cross sectional side elevational views of the quick connect-disconnect panel mounting means illustrating two steps of inserting the panel into the recreational vehicle range hood;

FIG. 4 is a view taken on line 4—4 of FIG. 2 and is similar to FIGS. 3*a* and 3*b* with the panel fully installed within a recreational vehicle range hood;

DETAILED DESCRIPTION OF THE PREFERRED EMBODIMENT

Figure 5:
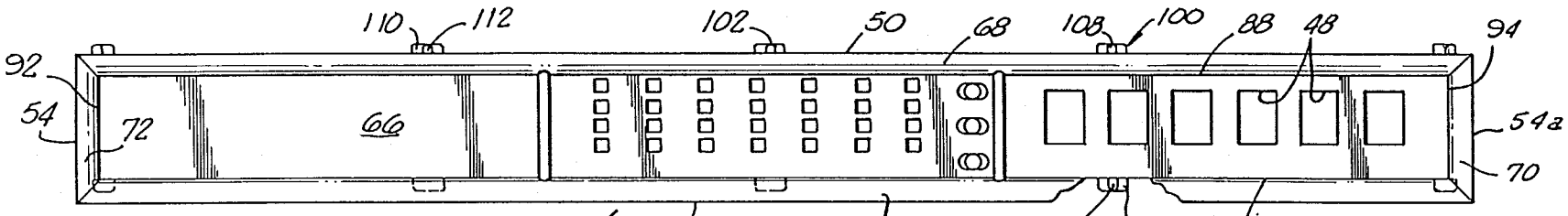
FIG. 5 is a front elevational view of a form of monitor panel employing the new quick connect-disconnect panel mounting means.

In FIG. 1 there is illustrated a conventional range hood for recreational vehicles generally designated 16. The hood 16 includes a pair of side walls 18 and 20 that are united with a back wall 22. Extending between and around the front top portions 24 and around the front ends 26 of the respective side walls 22 is a hood front cover member 28. The member 28 may be welded or otherwise secured to the side walls 18 and 20.

The interior of the range hood 16 may be fitted with a motor and fan (not seen) within box 30. In addition a light 32 may be fitted into the box. In the illustration a locking knob 34 is provided to hold a conventional filter 36 in the box 30 to filter grease during cooking.

In order to mount a monitor panel generally designated 44 in the range hood 16 the front cover member 28 is formed with a quadrilateral cut-out 46. The panel 44 is adapted to interfit within the cut out 46.

Dependent upon what monitoring functions are desired to be provided for eye observation, a number of openings 48 are provided to receive monitors. As one illustration, on the left side of the monitor panel 44 between top and bottom edges 50 and 52 respectively adjacent left edge 54 is an elongated cut out 56 to receive clock 58. Next to the clock cut-out 56 is another rectangular cut-out 60 that could receive a switch 62 which is contained within switch receptacle 64. The other cut outs 48 may be used for such things as registering water tank levels, etc.

The monitor panel 44 has a front face 66 which is preferably recessed from the marginal top, sides and bottom or frame portions 68, 70, 72 and 74 respectively of the panel. The portions 68, 70, 72 an 74 form a frame around the recessed front face 66.

Preferably mounted in the recessed front face 66 is plastic cover designated 78 which can be a single piece or as illustrated in FIG. 1 may be several pieces that cover the cut outs 48. Silk screening may provide indicia for reading the monitors The cover 78 may be applied to the recessed front face 66 by any appropriate means.

Projecting rearwardly from rear surface 82, see FIGS. 3*a*, 3*b*, 4 and 7 are a plurality of hollow projections 84 which receive monitoring gauges. In addition, attachment projections 86 may be provided to secure gauges and other monitoring means to the rear of the monitor panel 44.

Figure 6:
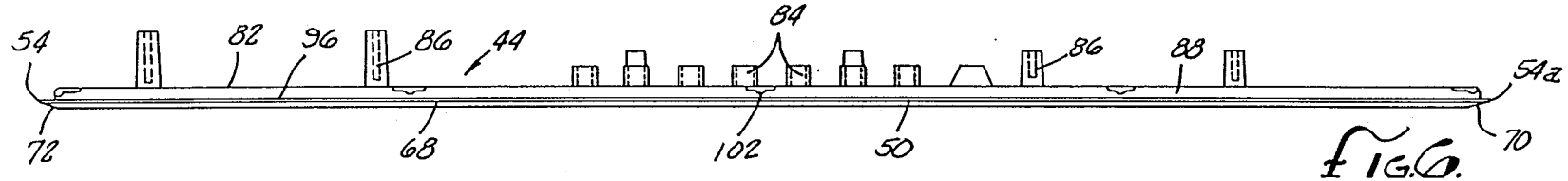
FIG. 6 is a top elevational view of the monitor panel of FIG. 5.
Figure 7:
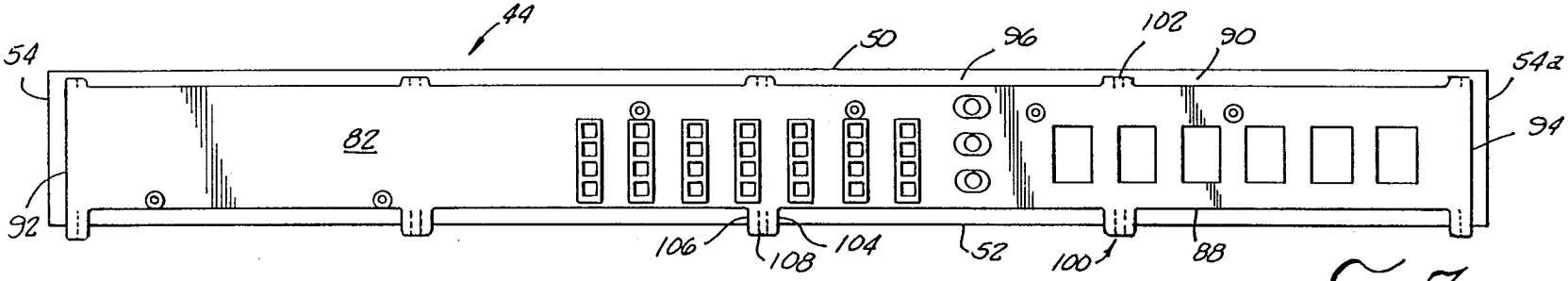
FIG. 7 is a rear elevational view of the monitor panel of FIG. 5.

Now referring particularly to the monitor panel 44 and particularly FIGS. 5, 6, and 7, the panel is preferably formed of a single sheet of plastic with the hollow projections 84, attachment projections 86 and openings 48.

At the back of the panel 44, see FIGS. 5 and 7 the rear surface 82 includes a portion defined by top edge 88, bottom edge 90, and end edges 92 and 94 respectively. The rear surface portion 82 is indented from the exterior top, bottom and edges 50, 52, 54 and 54*a* of the panel 44 forming an annular cover receiving recess. In addition the surface 82 projects outwardly of rear peripheral face 96, see FIGS. 3*a*, 3*b* and 7.

Projecting from the edges 88 and 90 are locking wall means or mounting clip means generally designated 100. These means 100 are to effect a quick connect-disconnect of the monitor panel 44 in the cut-out 46 of the range hood 16. With the construction to be described no tools are necessary nor extra strength to needed connect or disconnect the panel 44.

Figure 8:
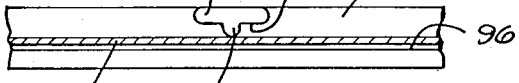
FIG. 8 is sectional view taken on line 8-8 of FIG. 4 showing a single quick connect-disconnect panel mounting means.

As best seen in FIGS. 6 through 8 the holding means 100 are tabs or extensions 102 extending from the bottom edge 92 and top edge 90. Preferably the tabs 100 are molded as a part of the panel 44. The tabs or extensions 102 preferably have a pair of generally parallel side 104 and 106, a top 108 and front face 110. The tabs 102 are spaced outwardly of the rear peripheral face 96, see FIGS. 3*a*, 3*b*, 4 and 6. The space between the front face of tabs 102 and surface 96 forms the cover or hood receiving recess to receive the edges (unnumbered) of the cut-out 46 in the front cover member 28.

Preferably, as best seen in FIG. 8, the tabs 102 each include a spacing extensions or elongated biasing projection or rib 112 which actually contacts the front cover member 28 when the panel 44 is installed. The biasing projection 112 narrowing the space between it and the peripheral face 96 will compensate for any variation in the thickness of the material of cover 28.

In addition, see FIG. 3*a*, 3*b*, 4 and 7, the tabs 102 that project beyond the top edge 50 are longer than the tabs 102 that project toward the bottom edge 52 of the panel 44.

In order to achieve a quick insertion of the monitor panel 44 without the use of tools the steps of FIGS. 3*a*, 3*b* and 4 are followed.

First the panel 44 is placed against the upper edge of cut-out 46 with the long tabs 102 inserted behind the cover 28, see FIG. 3*a*. The panel 44 is pushed up so that the edge of the cut-out will engage the top edge 88 of rear surface 82. At this point the lower shorter tabs 100, see FIG. 3*b* actually pass into the cut-out 46 adjacent a bottom edge thereof. The panel 44 is then allowed to drop and the bottom edge 90 of the rear surface 82 will bear against the bottom edge of the cut-out 46 in cover 28, as seen in FIG. 4. The panel 44 is then fully seated and positioned in the range hood 16.

When it is desired to remove the panel 44 for servicing of monitoring indicia or to replace the panel 44 with one having different monitoring means the reverse is true. The panel 44 is pushed upward, the bottom is sprung outwardly then the upper end is pulled forward and down dislodging the panel 44.

Figure 10:
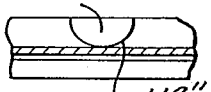
FIG. 10 is a further modified single quick connect-disconnect panel mounting means of FIG. 8.
Figure 9:
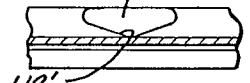
FIG. 9 is a modified single quick connect-disconnect panel mounting means of FIG. 8.

While the biasing projections 112, see FIG. 8, are preferably ribs the tabs 100 may be shaped as seen in FIGS. 9 and 10. In FIGS. 9 and 10 the clips 100′ and 100″ respectively may be formed with biasing projections 112′ and 112″ which are a pyramid or circular shape respectively.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. Quick connect-disconnect means as a part of a monitor panel, said panel for use in a range hood for recreational vehicles, said panel having top and bottom general parallel edges and a pair of generally parallel end edges, said panel forming a quadrilateral of a first area for releasable securement of said panel in a cut-out at the front of said range hood said cut-out is also a quadrilaterial having a top and bottom generally parallel edge and a pair of end edges forming a second area therebetween, and said first area of said panel is greater than said second cut-out area to allow said panel to overlay said cut out, the improvement including:

said monitor panel having a rear surface with an annular recess extending therearound inwardly from said panel top, bottom and pair of end edges forming an inner rear quadrilateral surface adapted to interfit within said second area formed by said cut out;

locking wall means on said inner rear quadrilateral surface of said panel extending at least toward said top and bottom generally parallel edges forming generally U shaped hood receiving recesses between said monitor panel and said locking wall mean, and said locking wall means at said top edge being longer than said other locking wall means at said bottom edge whereby said panel may be installed by passing the locking wall means behind said cut out and upward so that the top edge of said second area interfits within said U shaped hood receiving recess and then the bottom edge is moved inwardly so that said lower locking wall means passes into said cut-out along said bottom edge of said cut-out and then the monitor may be moved down so that the lower edge of said second area interfits within said U shaped hood receiving recess; and spacing extensions projecting into said U shaped hood receiving recesses adapted to reduce the size of said U shaped recess to accommodate the thickness of material in said range hood to achieve a relative tight fit.

2. A quick connect-disconnect means as defined in claim 1 wherein:

said locking wall means adjacent said top and bottom edge of said panel are a plurality of tabs to form the U shaped hood receiving recesses.

3. A quick connect-disconnect means as defined in claim 1 wherein:

said spacing extensions are ribs.

4. A quick connect-disconnect means as defined in claim 1 wherein:

said spacing extensions are deformations of said locking wall means.

5. A quick connect-disconnect means as defined in claim 2 wherein:

said tabs adjacent said top edge of said panel extend upward to a height above the top edge of said panel; and said tabs adjacent said bottom edge of said panel are shorter than said tabs adjacent said top edge.

* * * * *